US008615175B2

(12) United States Patent
Imada et al.

(10) Patent No.: US 8,615,175 B2
(45) Date of Patent: Dec. 24, 2013

(54) FIXING UNIT AND IMAGE FORMING APPARATUS INCLUDING SAME

(75) Inventors: Takahiro Imada, Kanagawa (JP); Masaaki Yoshikawa, Tokyo (JP); Kenji Ishii, Kanagawa (JP); Akira Shinshi, Tokyo (JP); Hiroshi Yoshinaga, Chiba (JP); Kenichi Hasegawa, Kanagawa (JP); Naoki Iwaya, Tokyo (JP); Yoshiki Yamaguchi, Kanagawa (JP); Tetsuo Tokuda, Kanagawa (JP); Yutaka Ikebuchi, Kanagawa (JP); Takamasa Hase, Kanagawa (JP); Ippei Fujimoto, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 295 days.

(21) Appl. No.: 13/048,167

(22) Filed: Mar. 15, 2011

(65) Prior Publication Data

US 2011/0222875 A1 Sep. 15, 2011

(30) Foreign Application Priority Data

Mar. 15, 2010 (JP) ..... 2010-057617

(51) Int. Cl.
*G03G 15/20* (2006.01)

(52) U.S. Cl.
USPC ..... 399/33; 399/70

(58) Field of Classification Search
USPC ..... 399/33, 70, 122
See application file for complete search history.

(56) References Cited

U.S. PATENT DOCUMENTS

| | | | | |
|---|---|---|---|---|
| 5,991,562 | A * | 11/1999 | Ito et al. | 399/67 |
| 7,869,753 | B2 | 1/2011 | Shinshi | |
| 8,364,052 | B2 | 1/2013 | Iwaya et al. | |
| 8,391,743 | B2 | 3/2013 | Yamaguchi et al. | |
| 8,401,448 | B2 | 3/2013 | Yamaguchi et al. | |
| 8,422,901 | B2 | 4/2013 | Ishii et al. | |
| 8,437,675 | B2 | 5/2013 | Ishii et al. | |

(Continued)

FOREIGN PATENT DOCUMENTS

| | | |
|---|---|---|
| JP | 10-20692 | 1/1998 |
| JP | 2000-112279 | 4/2000 |

(Continued)

OTHER PUBLICATIONS

Japanese Office Action mailed Oct. 7, 2013 or Japanese Patent Application No. 2010-057617.

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A fixing unit removably installable in an image forming apparatus includes an endless fixing member; a metal member disposed in proximity to an inner surface of the fixing member; a nip formation member supported by the metal member to slidably contact the fixing member or oppose the fixing member via a slide sheet; a heater to heat the metal member to heat the fixing member; a rotary pressing member to rotate the fixing member, disposed opposite the nip formation member via the fixing member to form a nip between the rotary pressing member and the fixing member; a rotation detector to detect a rotational state of the fixing member. Heating rotation of the fixing member is continuously performed until a predetermined rotational state of the fixing member is obtained, to spread lubricant substantially uniformly at least between the fixing member and the metal member.

16 Claims, 4 Drawing Sheets

(56) References Cited

U.S. PATENT DOCUMENTS

| | | | | |
|---|---|---|---|---|
| 2004/0101334 | A1* | 5/2004 | Tatematsu et al. | 399/329 |
| 2004/0105693 | A1* | 6/2004 | Akizuki et al. | 399/69 |
| 2007/0292175 | A1 | 12/2007 | Shinshi | |
| 2008/0112739 | A1 | 5/2008 | Shinshi | |
| 2008/0175633 | A1 | 7/2008 | Shinshi | |
| 2008/0298862 | A1 | 12/2008 | Shinshi | |
| 2009/0148174 | A1* | 6/2009 | Inomata | 399/44 |
| 2009/0311016 | A1* | 12/2009 | Shinshi | 399/329 |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0026987 | A1 | 2/2011 | Hasegawa | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064490 | A1 | 3/2011 | Imada et al. | |
| 2011/0064502 | A1 | 3/2011 | Hase et al. | |
| 2011/0085832 | A1 | 4/2011 | Hasegawa et al. | |
| 2011/0116848 | A1 | 5/2011 | Yamaguchi et al. | |
| 2011/0229161 | A1* | 9/2011 | Ueno et al. | 399/33 |

FOREIGN PATENT DOCUMENTS

| | | |
|---|---|---|
| JP | 2001-100575 | 4/2001 |
| JP | 8-76636 | 1/2002 |
| JP | 2005-326702 | 11/2005 |
| JP | 2007-293012 | 11/2007 |
| JP | 2008-275756 | 11/2008 |
| JP | 2008-275859 | 11/2008 |
| JP | 2009-3410 | 1/2009 |
| JP | 2009-288284 | 12/2009 |
| JP | 2010-26489 | 2/2010 |
| JP | 2010-054786 | 3/2010 |

* cited by examiner

FIXING UNIT AND IMAGE FORMING APPARATUS INCLUDING SAME

CROSS-REFERENCE TO RELATED APPLICATIONS

The present patent application claims priority pursuant to 35 U.S.C. §119 from Japanese Patent Application No. 2010-057617, filed on Mar. 15, 2010 in the Japan Patent Office, which is hereby incorporated herein by reference in its entirety.

BACKGROUND

1. Field

Exemplary embodiments of the present disclosure relate to a fixing unit and an image forming apparatus, such as a copier, a printer, a facsimile machine, or a multifunctional device having at least two of the foregoing capabilities, employing the fixing unit.

2. Description of the Background Art

Known replaceable fixing units include a flexible endless rotatable fixing member, a substantially-cylindrical metal member (hereinafter referred to as a metal pipe) provided in proximity to an inner circumferential surface of the fixing member, a nip formation member held on the metal pipe in direct contact with the fixing member or in indirect contact therewith via a slide sheet, a lubricant applied to the nip formation member or the metal pipe, a rotatable pressing member disposed opposing and parallel to the nip formation member via the fixing member, and a heater to heat the fixing member via the metal pipe. In the fixing unit, heat and pressure are applied to a toner image at a fixing nip formed by the fixing member, the metal pipe, the nip formation member, the lubricant, and the pressing member to fix the toner image on a recording medium.

In such a fixing unit, grease may be applied to an outer circumferential surface of the metal pipe and a sliding portion of the nip formation member to reduce friction during rotation. Insufficient application of grease to the sliding portion of the nip formation member and the outer circumferential surface of the metal pipe risks damaging the ungreased areas. In addition, such insufficient application of grease may require a higher driving torque to rotatably drive the pressing member, thus imposing more load on a drive source.

Further, since the nip formation member is wrapped by a slide sheet made from, for example, a PTFE fabric and grease is retained between fibers of the fabric, the sliding portion of the nip formation member is well protected by grease. By contrast, for the metal pipe, it is necessary to spread grease over the entire metal pipe both in the axial direction and the circumferential direction thereof. If grease is not sufficiently spread over the entire metal pipe, a portion of the metal pipe over which grease is not spread may experience undue wear.

The above-described insufficiency of grease on the sliding portion and the metal pipe also refers not only to an absolute lack but also to a relative or localized lack of sufficient lubrication, that is, to a state in which, for example, when grease is additionally applied to the fixing unit before use or during maintenance, some portions are not covered with grease although grease must be applied over the entire metal pipe both in the axial and circumferential directions thereof. The reason why such a state occurs is that, because it is difficult and cumbersome for a person to apply grease uniformly to the entire metal pipe both in the axial and circumferential directions thereof, grease is applied to several positions (at least one position) in a dotted manner so that grease is naturally spread during operation of the fixing unit. In other words, there is a limitation in uniformly applying grease in such a way, resulting in the above-described insufficient spread state.

Therefore, in order to sufficiently spread grease, it is effective to rotate at least one of the portion to which grease is applied and the sliding portion that slides over the portion to which grease is applied so as to spread the grease over the entire metal pipe both in the axial and circumferential directions thereof. However, as far as the inventors of the present application are aware, there does not exist any fixing unit including a unit capable of spreading applied grease and any image forming apparatus including such a unit.

An additional factor involves grease viscosity. To prevent grease having a high viscosity at ordinary temperature from increasing the required torque, the conventional art heats grease in advance and then starts rotation, thus reducing the torque. However, grease is heated in a non-rotational state, and then printing is performed while rotationally heating the grease. As a result, when printing starts, grease is not sufficiently spread, resulting in the above-described failure.

In addition, a certain rotational state may not be obtained (for example, a torque of a certain level or less may not be obtained) due to variation in components of a fixing unit. Several reasons are possible for the failure in which a certain level or less of torque is not obtained. For example, when the parallelity between the fixing member (such as a pipe or a belt) and a pressure roller is lost, more grease may gather at one side in the axial direction than at the other side, thus preventing torque from attaining a certain level or less. When a gap between the outer circumferential surface of the metal pipe and the inner circumferential surface of the fixing belt is small (for example, due to defective components), the fixing belt and the metal pipe strongly contact each other, thus preventing the torque from attaining a certain level or less. In such a state, since it is useless to continue heating and rotation, it is desirable to stop operation and replace the fixing unit. However, as far as the inventors of the present application are aware, there is no conventional art for causing users to do such replacement.

SUMMARY

In an aspect of this disclosure, there is provided an improved fixing unit removably installable in an image forming apparatus. The fixing unit includes an endless, flexible fixing member, a substantially cylindrical metal member, a nip formation member, a lubricant, a heater, a rotary pressing member, and a rotation detector. The substantially cylindrical metal member is disposed in proximity to an inner circumferential surface of the fixing member. The nip formation member is supported by the metal member to slidably contact the fixing member or oppose the fixing member via a slide sheet. The lubricant is provided between the fixing member and each of the metal member and the nip formation member. The heater heats the metal member to heat the fixing member. The rotary pressing member rotates the fixing member and is disposed opposite and parallel to the nip formation member via the fixing member to form a nip between the rotary pressing member and the fixing member through which a recording medium bearing an image passes, with heat of the heater and pressure of the pressing member applied to the image on the recording medium at the nip to fix the image on the recording medium. The rotation detector detects a rotational state of the fixing member. Heating rotation of the fixing member is continuously performed until a predetermined rotational state of the fixing member is obtained, to spread the lubricant substantially uniformly at least between the fixing member and the metal member.

In an aspect of this disclosure, there is provided an improved image forming apparatus including the fixing unit described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
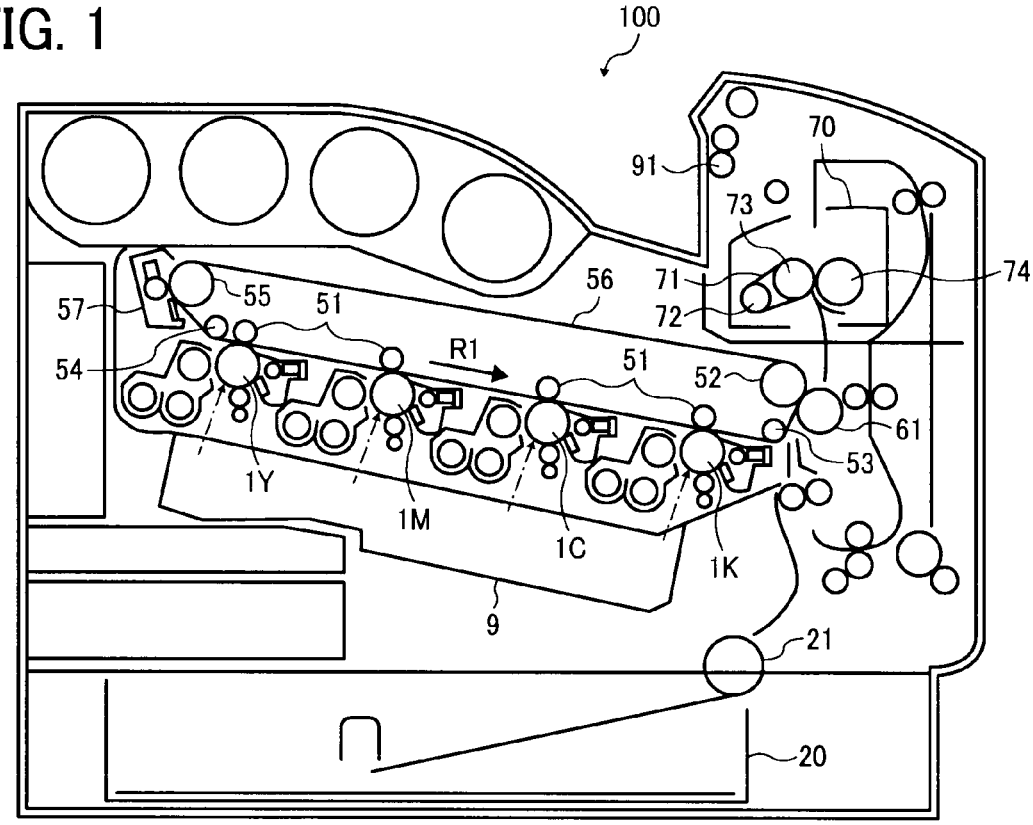
FIG. 1 is a cross-sectional view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below with reference to FIGS. 1 to 7.

FIG. 1 is a cross-sectional view of an image forming apparatus 100 according to an exemplary embodiment of the present disclosure.

A fixing unit 70 according to an exemplary embodiment of the present disclosure performs heating rotation to spread grease. More particularly, after grease is additionally applied in installation of a new unit or during maintenance, the fixing unit 70 performs the heating rotation to spread grease.

For example, with the image forming apparatus 100 turned off, the fixing unit 70 is replaced with a new one or grease is additionally applied to the fixing unit 70 as part of a maintenance regime. When the image forming apparatus 100 is turned on again after the replacement of the fixing unit 70 or the additional application of grease, the image forming apparatus 100 heats a fixing member (e.g., fixing belt) 71 as its initial operation to raise the temperature of the fixing member 71. After the warm-up of the fixing member 71 is completed (i.e., the fixing member 71 reaches a predetermined temperature), the image forming apparatus 100 causes the fixing member 71 to perform heating rotation to spread grease. In a case in which, for example, a print job is already inputted before activation is completed, the heating rotation may be performed in a stand-by state after both the warm-up and the print job are completed (i.e., a state in which the temperature of the fixing member 71 is held at the predetermined temperature to be ready for a subsequent print job).

Such operation prevents failures, such as an increase in driving torque or mechanical damage caused by wear of an area in which grease is not sufficiently spread over a sliding portion of a fixing unit 70 and a metal pipe described below. Accordingly, such operation allows grease to uniformly spread over the surface of the metal pipe and the sliding portion of the unit, thus reducing the torque and preventing mechanical damage such as wear of the sliding portion of the unit and the metal pipe.

If a desired rotational state cannot be obtained even after a predetermined period of time passes, it is desirable to display a message on a control panel of the image forming apparatus 100 so as to prompt a user to replace the fixing unit 70 or call a service person (hereinafter referred to as maintenance requirement indication). In other words, even when the heating rotation is continued, a desired rotational state may not be obtained (for example, a torque of a certain level or less may not be attained) depending on variation in components of the fixing unit 70. In such a case, it is necessary to discontinue the above heating rotation. Accordingly, the maintenance requirement indication is displayed to alert a user, thus preventing the heating rotation from endlessly continuing. It should be noted that the term "maintenance" used herein refers to not only maintenance in the strict sense but also all operations for maintenance, such as inspection and replacement.

In addition, the amount of engagement (inter-axis distance) between the fixing member and the pressing member is changed depending on the operating mode of the image forming apparatus 100. The amount of engagement between the fixing member and the pressing member during the above-described heating rotation is set to be less than that in any other operating mode. Since the heating rotation is performed with a pressing force sufficient to rotate the fixing member and the pressing member in a desired state, the inter-axis distance is set at the minimum value, thus minimizing deterioration of the members caused by the heating rotation.

The control temperature of the above-described heating rotation is set at a temperature lower than a fixing control temperature of any other normal operating mode. This is because, when the viscosity of grease decreases to a certain extent, the grease spreads over the entire sliding portion uniformly, thus eliminating the necessity to increase the temperature to the fixing control temperature. Performing the heating rotation at a low temperature prevents deterioration of the grease and thermal deterioration of components affected by the heating operation, resulting in a reduction in power consumption.

When the rotation speed and the rotational linear velocity of the heating rotation are too high, the torque may increase, resulting in wear of the sliding portion and the metal pipe. Hence, to minimize the stress on the fixing unit 70 during the heating rotation, the rotation speed and the linear velocity are reduced to the lowest possible level, thus spreading the grease over the sliding portion and the metal pipe portion with the minimum mechanical load.

It is preferable to perform the heating rotation both in forward and backward directions. If the heating rotation is performed in only one direction, grease tends to be applied in a non-uniform manner and cause grease to accumulate. In other words, if the rotation direction is only one direction, grease spreads unevenly in the circumferential direction of the metal pipe. Hence, for the fixing unit 70, the rotational direction is changed to spread grease evenly over the entire area in the circumferential direction of the metal pipe. Accordingly, grease is extended over the sliding portion and the metal pipe, thus preventing mechanical damage.

When installation of a new fixing unit 70 is detected, the above-described heating rotation is performed. This is because it is conceivable that grease is hardly spread over the metal pipe and the sliding portion of the new unit and the new unit has a relatively large torque. Hence, the heating rotation is performed in the new unit to spread grease over the entire sliding portion and the metal pipe, thus reducing the torque and preventing mechanical damage.

In addition, it is preferable to allow a service person and a user to optionally (selectively) execute the heating rotation. For example, when a service person additionally applies grease, torque increases unless the grease is sufficiently spread. Hence, the image forming apparatus 100 allows the service person to optionally execute the heating rotation after additional application of the grease, thus preventing occurrence of the above-described failure.

When a print request is received during the heating rotation, it is preferable to allow selection of which of the print request and the active heating rotation is prioritized. When a print request is received during the heating rotation, a user may be kept waiting unless the print request is permitted. In such a state, it is considered that it is preferable to allow the user to select which of the heating rotation and the print request is prioritized.

Exemplary Embodiment

Next, the image forming apparatus 100 according to an exemplary embodiment of the present disclosure is described in more detail with reference to FIG. 1.

In FIG. 1, the image forming apparatus 100 is a digital-color multifunction apparatus. However, it is to be noted that the image forming apparatus may be any other suitable type of image forming apparatus, such as a copier, a facsimile machine, a printer, or a multifunction printer having at least one of copying, printing, scanning, plotter, and facsimile functions.

The image forming apparatus 100 in FIG. 1 has an intermediate transfer belt 56 provided at a substantially central portion in the image forming apparatus 100. The intermediate transfer belt 56 includes heat-resistant material, such as polyimide and polyamide. The intermediate transfer belt 56 is an endless belt including a base member of a moderate resistance and is supported by and looped around four rollers 52, 53, 54, and 55. The intermediate transfer belt 56 is rotated in a direction indicated by an arrow A in FIG. 1.

Below the intermediate transfer belt 56, four image forming units corresponding to respective toners of yellow (Y), magenta (M), cyan (C), and black (K) are arranged along a belt surface of the intermediate transfer belt 56.

Below the four image generation units is disposed an exposure device 9 to expose electrically charged surfaces of photoconductors 1 (1Y, 1M, 1C, and 1K) in accordance with image data for respective colors to form latent images on the surfaces of the photoconductors.

Primary transfer rollers 51 are provided opposing the corresponding photoconductors 1 via the intermediate transfer belt 56. The primary transfer rollers 51 primarily transfer toner images from the photoconductors 1 onto the intermediate transfer belt 56. The primary transfer rollers 51 are connected to a power supply that supplies a predetermined voltage thereto.

A secondary transfer roller 61 is pressed against an outer portion of the intermediate transfer belt 56 supported by a roller 52. The secondary transfer roller 61 is connected to a power supply that supplies a predetermined voltage thereto. A contact portion between the secondary transfer roller 61 and the intermediate transfer belt 56 is a secondary transfer portion at which the toner images on the intermediate transfer belt 56 are transferred onto a recording medium (e.g., a recording sheet or a transfer sheet).

An intermediate-transfer-belt cleaning device 57 is provided at an outer portion of the intermediate transfer belt 56 supported by a roller 55 to clean the surface of the intermediate transfer belt 56 after the secondary transfer.

The fixing unit 70 is provided above the secondary transfer portion to fix the toner image on the recording sheet. The fixing unit 70 includes a heating roller 72 having a halogen heater therein, an endless fixing belt 71 looped around a fixing roller 73, and a pressure roller 74 disposed opposing and pressed against the fixing roller 73 via the fixing belt 71.

At a lower portion of the image forming apparatus 100 is provided a feeding device 20 to store recording sheets and feed the recording sheets to the secondary transfer portion.

It is to be noted that the fixing unit 70 of FIG. 1 has a structure slightly different from a fixing unit described below. This means that the fixing unit 70 of FIG. 1 is merely an exemplification. In other words, the image forming apparatus is not limited to the same structure as that of the image forming apparatus 100 illustrated in FIG. 1.

Next, operation of a fixing unit 70 used in the image forming apparatus 100 is described below.

Figure 2:
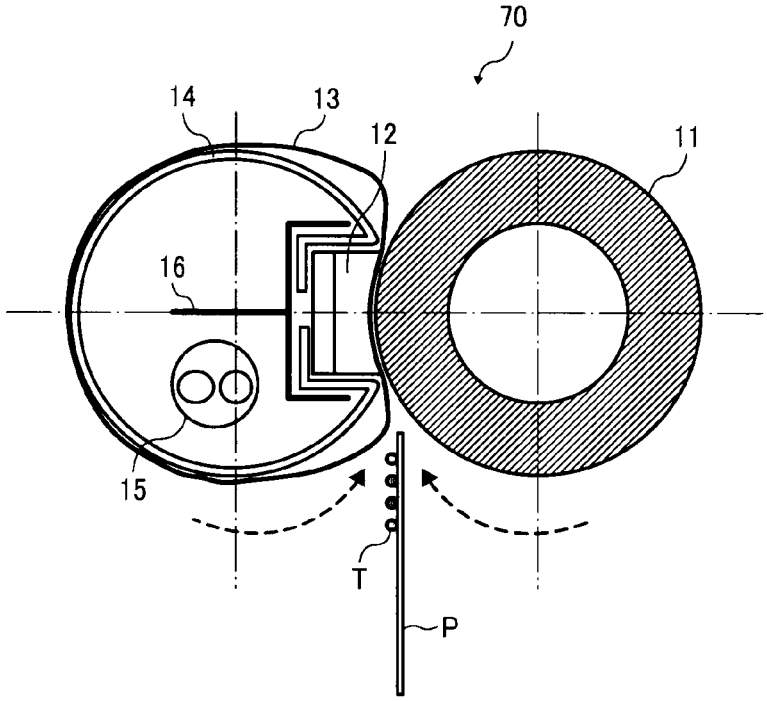
FIG. 2 is a cross-sectional view of a fixing unit according to an exemplary embodiment of the present disclosure.

FIG. 2 is a cross sectional view illustrating the fixing unit (or fixing device) 70 according to an exemplary embodiment of the present disclosure.

In FIG. 2, the fixing unit 70 includes a pressure member 11 includes a metal core and silicone rubber; a nip formation member 12 made of, for example, fluororubber wrapped with a PTFE sheet; a fixing belt 13 including a base member of, for example, SUS and/or Ni and a surface layer of silicone rubber and/or PFA; a metal pipe 14 including a base member of, for example, SUS and/or Ni and an outer circumferential surface (preferably coated with fluorine slidable coating) in sliding contact with the fixing belt 13; a heater 15 to heat the metal pipe 14, and a reinforcement stay 16 to reinforce the nip formation member 12. In the fixing unit 70, when the heater 15 generates heat, the metal pipe 14 is heated, thus increasing the temperature of the fixing belt 13 in contact with the metal pipe 14 A fixing nip is formed by the fixing belt 13, the nip formation member 12, and the pressing member 11 whose temperature has reached a fixing temperature. When the recording sheet P on which an image is formed with toner T is sandwiched at the nip, the toner T is fixed on the recording sheet P as a toner image. The fixing bet 13 whose temperature has decreased due to the fixing operation is heated by the heater 15 again.

Grease is applied between the nip formation member 12 and the fixing belt 13 and/or between the fixing belt 13 and the metal pipe 14. In particular, grease tends to be needed between the fixing belt 13 and the metal pipe 14. If there is a small portion where grease is not applied, the portion tends to be worn. The grease used in the fixing unit 70 has high viscosity at normal temperatures and hardly spreads to an area between the members. However, the viscosity decreases at high temperatures, thus increasing the fluidity. As a result, the grease goes across the area between the members, and sufficiently spread over the area between the members.

Figure 3:
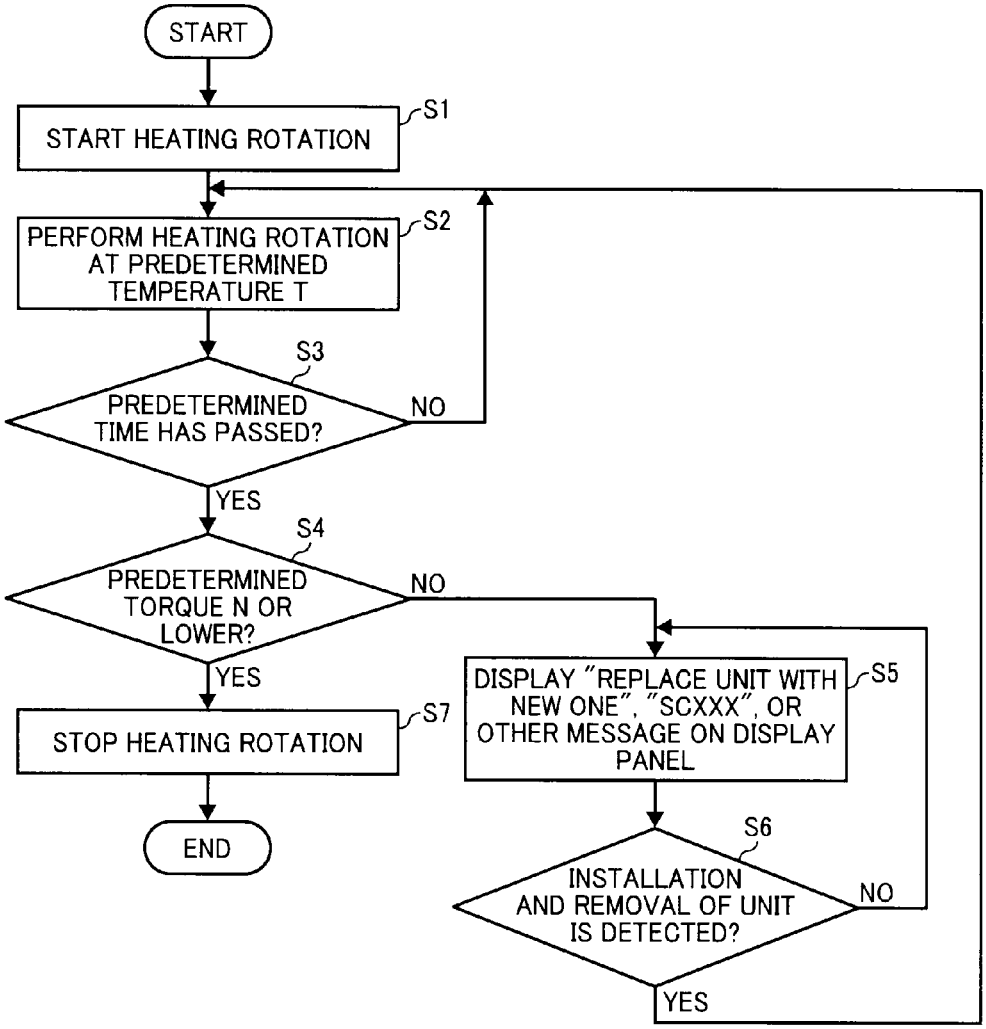
FIG. 3 is a flowchart illustrating an alert procedure.

Next, operation of the fixing device is described with reference to a flowchart of FIG. 3.

The following is described of a case in which a mechanism for measuring the torque of the fixing unit is provided. Alternatively, instead of measuring the torque, for example, an electric current flowing through a motor may be detected using a detector, or a speed sensor may be provided to terminate the process when the linear velocity of the surface of the fixing belt 13 becomes the same as the linear velocity of the surface of the pressure roller 11. Alternatively, without such detection mechanisms, the rotation may be stopped when a predetermined period of time passes.

First, when the heating rotation for spreading grease starts at S1, at S2 the above-mentioned members are heated at a predetermined constant temperature T while being rotated. The heating rotation continues until a predetermined period of time A passes (S3). If the predetermined period of time A passes (YES at S3), torque is measured. At S4, it is determined whether the measured torque is equal to or less than a predetermined threshold N. If the torque is determined to be equal to or less than the predetermined threshold N (YES at S4), the heating rotation for spreading grease is terminated at S7.

By contrast, if the measured torque is determined to be greater than the predetermined threshold N (NO at S4), at S5 a display panel serving as a display unit of the image forming apparatus 100 displays a message, such as "please replace fixing unit with new one", "SCXXX", or other message to prompt a user to contact a service person. When a user replaces the fixing unit, or a service person additionally apply grease to the fixing unit, the fixing unit is removed from and installed into the image forming apparatus 100. Hence, if the installation and removal are detected (YES at S6), the process goes back to S2 and the heating operation starts again. By performing the heating rotation at a certain temperature for a predetermined period of time, grease uniformly spreads between the nip formation member 12 and the fixing belt 13 and/or between the fixing belt 13 and the metal pipe 14. Such a configuration prevents wear of these members and reduces the torque, thus extending the product life of the unit.

Figure 4:
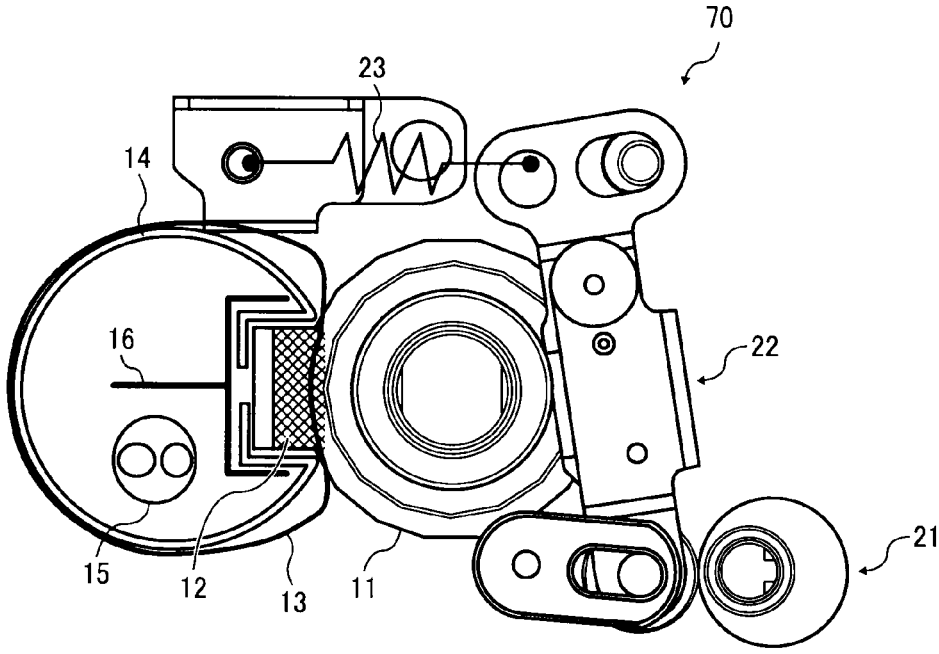
FIG. 4 is a cross-sectional view of a configuration in which an inter-axis distance adjustment mechanism is added to the fixing unit illustrated in FIG. 2.

FIG. 4 is a cross-sectional view of a configuration in which an inter-axis distance adjustment mechanism is added to the fixing unit illustrated in FIG. 2.

In FIG. 4, the inter-axis distance adjustment mechanism includes a pressure lever 22 to adjust the amount of engagement of the pressure roller 11, an eccentric cam 21 to push the pressure lever 22, and a spring 23 to pull the pressure lever 22. FIG. 4 illustrates a state in which the amount of displacement of the eccentric cam 21 is at the smallest. When a recording medium passes through the nip in the fixing unit, the eccentric cam 21 is rotated and the pressure lever 22 is pressed against the pressure roller 11.

If the amount of engagement of the pressure roller 11 with the fixing belt cannot be adjusted, during the heating rotation for spreading grease, the fixing belt is rotated with the same amount of engagement as that of fixing operation, thus applying a high load to the fixing unit even in the heating rotation for spreading the grease. The mechanism for changing the amount of engagement as shown in the mechanism of FIG. 4 is provided, and the fixing belt 13 is rotated with the necessary minimum amount of engagement for the rotation of the fixing belt 13, so that the heating/rotation can be given and the grease can be spread on the portion between the nip formation member 12 and the fixing belt 13 and between the fixing belt 13 and the metal pipe 14 with the minimum drive stress.

Figure 5:
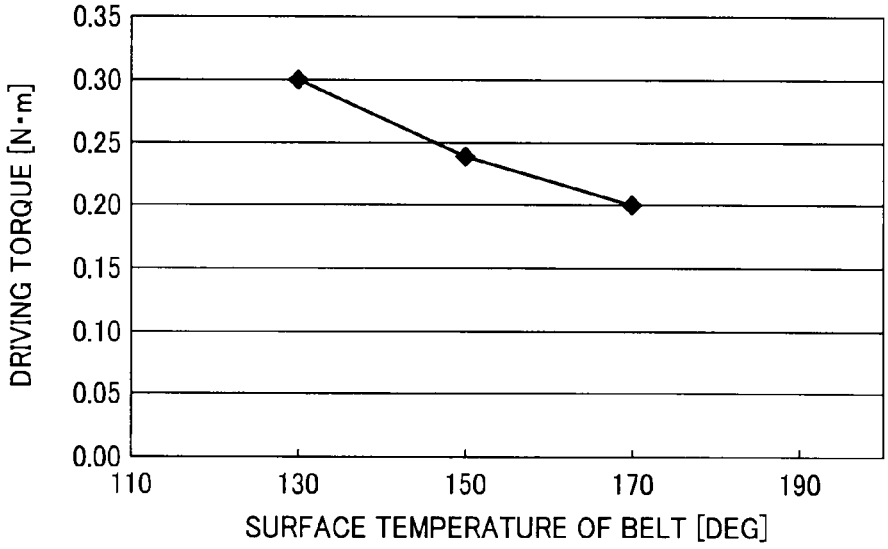
FIG. 5 is a graph showing measurement results of the driving torque of a fixing unit observed when the temperature of a surface of a fixing belt is changed with the linear velocity of the surface of the fixing belt held constant.

FIG. 5 is a graph showing measurement results of driving torque of the fixing unit observed when the surface temperature of the fixing belt 13 is changed with the linear velocity of the surface of the fixing belt held constant.

The graph shows that the higher the temperature of the grease is, the lower the viscosity of the grease is. As a result, the driving torque for rotating the fixing unit decreases. The surface temperature of the fixing belt 13 needed for actual fixing operation is considered to be, for example, approximately 150 degrees C. or more. The higher the temperature is, the lower the viscosity of the grease is. However, since the grease itself is deteriorated by heat, it is preferable not to raise the temperature too high. Hence, in the present exemplary embodiment, to reduce the thermal deterioration of the grease, the heating rotation is performed at a temperature (e.g., approximately 120 degrees C.) lower than the temperature range of the fixing operation. Thus, the viscosity of grease can be reduced without raising the surface temperature of the fixing belt 13 too high, thus spreading the grease between the members. As a result, the thermal deterioration of the grease is minimized while reducing the power consumption of the heater.

Figure 6:
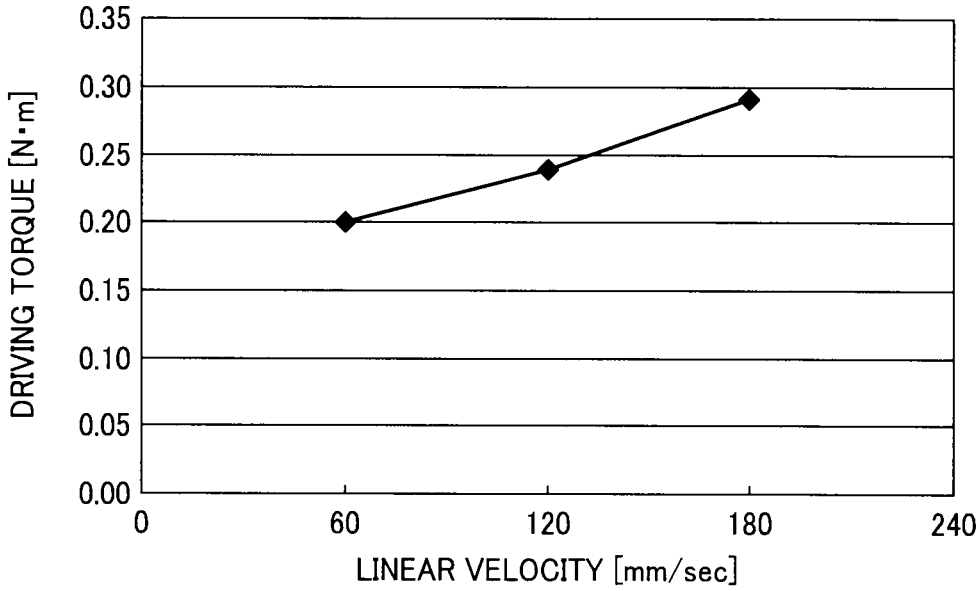
FIG. 6 is a graph showing measurement results of driving torque observed when the linear velocity of the fixing unit (the rotation speed of a pressure roller) is changed with the temperature of the surface of the fixing belt held constant.

FIG. 6 is a graph showing measurement results of driving torque of the fixing unit observed when the linear velocity of the fixing unit (the rotation speed of the pressure roller 11) is changed with the temperature of the surface of the fixing belt 13 held constant.

FIG. 6 shows that the faster the linear velocity of the surface of the fixing belt 13 is (the higher the rotation speed is), the higher the torque (and thus the load) of the fixing unit is. In the present embodiment, in view of this phenomenon, the linear velocity of the surface of the fixing belt 13 during the heating rotation is set at, for example, 40 mm/second so that the heating rotation is performed at a rotation speed lower than that of a normal sheet feeding mode and with a lower load. Such a configuration can apply the grease to the portion(s) between the members with a relatively low mechanical load, and uniformly spread the grease thereto, thus preventing mechanical damage of the members.

Figure 7:
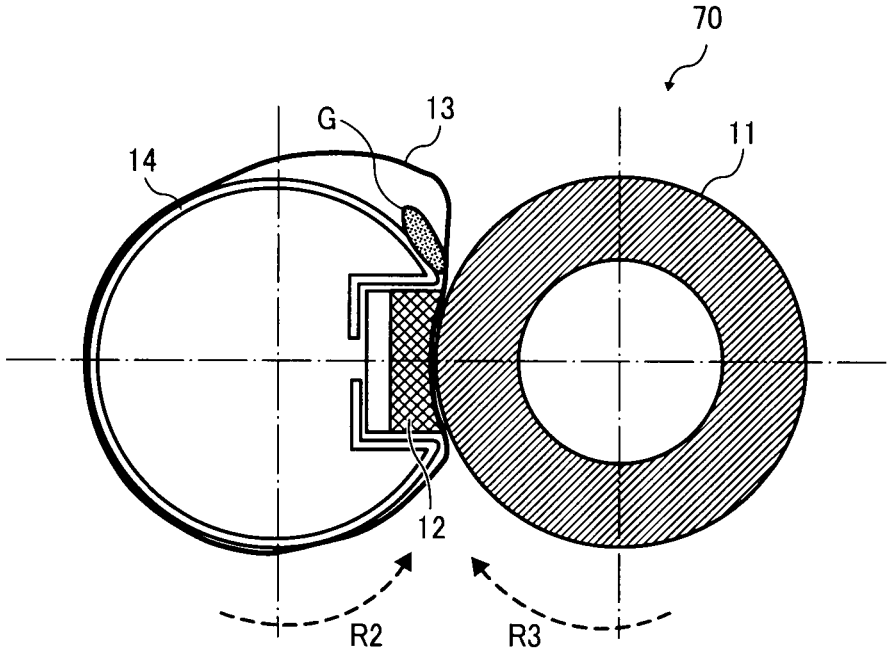
FIG. 7 is a cross-sectional view of a state in which grease accumulates in a fixing unit.

FIG. 7 is a cross-sectional view of grease accumulation in the fixing unit.

FIG. 7 shows a space between the fixing belt 13 and the metal pipe 14 formed when each of the fixing belt 13 and the pressing roller 11 is rotated in a forward direction (indicated by an arrow R2 and an arrow R3, respectively, in FIG. 7). When the fixing belt 13 is rotated in the forward direction R2, the fixing belt 13 is loosened at the exit side of the nip (i.e., an area downstream from the nip in the direction R2 of the forward rotation of the fixing belt 13 in FIG. 7). If the grease G accumulates at the area, the grease may not spread over the entire outer circumferential surface of the metal pipe 14.

Hence, after the forward rotation, a backward rotation in a direction opposite to the direction indicated by each of the arrows R2 and R3 in FIG. 7 is performed. As a result, at the entry side of the nip (an area upstream from the nip in the direction R2 of the forward rotation of the fixing belt 13 in FIG. 7), the fixing belt 13 is loosened. By contrast, at the exit side of the nip, the fixing belt 13 is stretched taut along the metal pipe 14. As a result, the grease G accumulating at the exit side of the nip in FIG. 6 starts to spread toward the entry side of the nip (the lower side of the nip in FIG. 7). Accordingly, the grease G accumulating between the fixing belt 13 and the metal pipe 14 can be uniformly spread, thus reducing the torque and preventing mechanical damage.

When the fixing unit 70 is a new unit, the grease may not sufficiently spread. Hence, a new-unit detector may be provided between the fixing unit 70 and the image forming apparatus 100. In such a case, when the new-unit detector detects that a new fixing unit is installed in the image forming apparatus 100, the heating rotation is performed according to the procedure illustrated in FIG. 3. As a result, the grease between the fixing belt 13 and the metal pipe 14 and between the nip formation member 12 and the fixing belt 13 are spread over the entire members. Such a configuration prevents a user from feeding a recording sheet before the grease sufficiently spreads, thus preventing wear of a portion over which the grease is not spread and extending the product life of the fixing unit.

For example, if the use of the fixing unit causes deterioration of grease and increase in torque, a user may wipe the grease and apply new grease or additionally apply grease without wiping the old grease. In such a case, even if the user intends to uniformly apply the grease, the grease may not be sufficiently spread. Hence, the user may operate the main-unit side (e.g., the display unit) of the image forming apparatus 100 to optionally perform the heating rotation, thus sufficiently spreading additionally-applied grease to the entire portion between the members.

Since it takes a certain period of time to perform the heating rotation, image formation may be interruptingly requested by a user during the heating rotation. In this case, through the setting of the main-unit side (e.g., the display unit), the image forming apparatus may allow a user to select which of the image formation request and the heating rotation for spreading the grease is to be preferentially performed. For example, a user may output a print request from a personal computer (PC) while the heating operation is performed in the image forming apparatus. In such a case, if the printing operation is preferentially performed, it is not necessary to display any particular indication on a screen of the user's PC. However, when the heating rotation for spreading the grease is preferentially performed, it is preferable to notify the PC of the user that printing cannot be immediately performed. For example, an indication "machine is in preparation" may be displayed on the screen of the user's PC. Such a configuration prevents the user from mistaking it for the malfunction of the PC or the image forming apparatus.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing unit removably installable in an image forming apparatus, comprising:

an endless, flexible fixing member;

a substantially cylindrical metal member disposed in proximity to an inner circumferential surface of the fixing member;

a nip formation member supported by the metal member to slidably contact the fixing member or oppose the fixing member via a slide sheet;

a heater to heat the metal member to heat the fixing member;

a rotary pressing member to rotate the fixing member, disposed opposite and parallel to the nip formation member via the fixing member to form a nip between the rotary pressing member and the fixing member through which a recording medium bearing an image passes, with heat of the heater and pressure of the pressing member applied to the image on the recording medium at the nip to fix the image on the recording medium; and a rotation detector to detect a rotational state of the fixing member, wherein heating rotation of the fixing member is continuously performed until a predetermined rotational state of the fixing member is obtained, to spread a lubricant substantially uniformly at least between the fixing member and the metal member, wherein an indication for requesting maintenance is created when the rotation detector determines that the predetermined rotational state is not obtained after a threshold period of time elapses.

2. The fixing unit according to claim 1, wherein the heating rotation is performed in a predetermined period of time excluding activation, recovery, and fixing operations of the fixing unit.

3. The fixing unit according to claim 1, further comprising an inter-axis distance adjustment mechanism to adjust an inter-axis distance between the fixing member and the pressing member to change an amount of engagement of the fixing member and the pressing member in a plurality of setting modes of the image forming apparatus, wherein the amount of engagement of the fixing member and the pressing member in a setting mode for the heating operation is set smaller than in any other setting mode for fixing in the image forming apparatus.

4. The fixing unit according to claim 1, wherein a control temperature of a setting mode for the heating rotation is set lower than a control temperature of any other setting mode for fixing in the image forming apparatus.

5. The fixing unit according to claim 1, wherein rotation speed and linear velocity of the fixing member in the heating rotation are lower than in any other setting mode for fixing in the image forming apparatus.

6. The fixing unit according to claim 1, further comprising:

the lubricant which is provided between the fixing member and each of the metal member and the nip formation member.

7. An image forming apparatus comprising a fixing unit removably installable in the image forming apparatus, the fixing unit comprising:

an endless, flexible fixing member;

a substantially cylindrical metal member disposed in proximity to an inner circumferential surface of the fixing member;

a nip formation member supported by the metal member to slidably contact the fixing member or oppose the fixing member via a slide sheet;

a heater to heat the metal member to heat the fixing member;

a rotary pressing member to rotate the fixing member, disposed opposite and parallel to the nip formation member via the fixing member to form a nip between the rotary pressing member and the fixing member through which a recording medium bearing an image passes, with heat of the heater and pressure of the pressing member applied to the image on the recording medium at the nip to fix the image on the recording medium; and a rotation detector to detect a rotational state of the fixing member, wherein heating rotation of the fixing member is continuously performed until a predetermined rotational state of the fixing member is obtained, to spread a lubricant substantially uniformly at least between the fixing member and the metal member, and the image forming apparatus further comprises a display unit to display an indication for requesting maintenance the rotation detector determines that the predetermined rotational state is not obtained after a threshold period of time elapses.

8. The image forming apparatus of claim 7, wherein the heating rotation is performed in a predetermined period of time excluding activation, recovery, and fixing operations of the fixing unit.

9. The image forming apparatus according to claim 7, wherein the heating rotation is optionally executable through the display unit.

10. The image forming apparatus according to claim 9, wherein, when image formation is requested during the heating rotation, whether the image formation is to be prioritized or the heating rotation is to be prioritized is selectable through the display unit.

11. The image forming apparatus according to claim 7, further comprising an inter-axis distance adjustment mechanism to adjust an inter-axis distance between the fixing member and the pressing member to change an amount of engagement of the fixing member and the pressing member in a plurality of setting modes of the image forming apparatus, wherein the amount of engagement of the fixing member and the pressing member in a setting mode for the heating operation is set smaller than in any other setting mode for fixing in the image forming apparatus.

12. The image forming apparatus according to claim 7, wherein a control temperature of a setting mode for the heating rotation is set lower than a control temperature of any other setting mode for fixing in the image forming apparatus.

13. The image forming apparatus according to claim 7, wherein rotation speed and linear velocity of the fixing member in the heating rotation are lower than in any other setting mode for fixing in the image forming apparatus.

14. The image forming apparatus according to claim 7, further comprising:

the lubricant which is provided between the fixing member and each of the metal member and the nip formation member.

15. An image forming apparatus comprising a fixing unit removably installable in the image forming apparatus, the fixing unit comprising:

an endless, flexible fixing member;

a substantially cylindrical metal member disposed in proximity to an inner circumferential surface of the fixing member;

a nip formation member supported by the metal member to slidably contact the fixing member or oppose the fixing member via a slide sheet;

a heater to heat the metal member to heat the fixing member;

a rotary pressing member to rotate the fixing member, disposed opposite and parallel to the nip formation member via the fixing member to form a nip between the rotary pressing member and the fixing member through which a recording medium bearing an image passes, with heat of the heater and pressure of the pressing member applied to the image on the recording medium at the nip to fix the image on the recording medium; and a rotation detector to detect a rotational state of the fixing member, wherein heating rotation of the fixing member is continuously performed until a predetermined rotational state of the fixing member is obtained, to spread a lubricant substantially uniformly at least between the fixing member and the metal member, and the image forming apparatus further comprising a unit detector to detect whether the fixing unit is a new one, wherein, when the unit detector detects that the fixing unit is the new one, the heating rotation is started upon installation of the fixing unit in the image forming apparatus.

16. The image forming apparatus according to claim 15, further comprising:

the lubricant which is provided between the fixing member and each of the metal member and the nip formation member.

* * * * *